United States Patent [19]

Desaar

[11] Patent Number: 4,492,365

[45] Date of Patent: Jan. 8, 1985

[54] POROUS NOZZLE FOR BLOWING GAS THROUGH STEEL

[76] Inventor: René Desaar, rue Michel Body, 67, B-4330 Grace-Hologne, Belgium

[21] Appl. No.: 508,165

[22] Filed: Jun. 27, 1983

[30] Foreign Application Priority Data

Jun. 25, 1982 [BE] Belgium ..... 208450

[51] Int. Cl.[3] ..... C21C 5/32

[52] U.S. Cl. ..... 266/220; 266/225

[58] Field of Search ..... 266/220, 225, 265; 75/60; 428/36, 256, 472

[56] References Cited

U.S. PATENT DOCUMENTS

| | | | |
|---|---|---|---|
| 3,490,755 | 1/1970 | Lutgen | 266/220 |
| 3,610,602 | 10/1971 | Deacon et al. | 266/220 |
| 3,799,522 | 3/1974 | Brant et al. | 266/225 |
| 4,090,336 | 5/1978 | Carroll | 428/256 |
| 4,179,103 | 12/1979 | Bentz et al. | 266/220 |
| 4,276,331 | 6/1981 | Bothwell | 428/36 |

*Primary Examiner*—L. Dewayne Rutledge
*Assistant Examiner*—Robert L. McDowell
*Attorney, Agent, or Firm*—Young & Thompson

[57] ABSTRACT

A porous nozzle for blowing gas through a bath of steel, comprises a body (1) of solid porous material, having on its upper face a bushing (2) for securing the body to the end of a blowing lance. The body is formed with a central cylindrical cavity (3) which is in communication with the interior of the bushing (2) for receiving an inert gas from the lance. A large mesh grill (4) which is embedded in the body, encloses the central cavity (3) so as to reinforce the porous material of the body (1). A metal ring (5) is secured about the bushing (2), and the grill (4) is welded to this metal ring (5). There is an anchoring member (6) welded to the periphery of the bushing (2) so as to fasten more securely the porous material constituting the body (1), this anchoring member being embedded in the porous material. The anchoring member (6) is cylindrical and lies outside of and is concentric with the grill (4). The grill (4) is cylindrical and terminates in an end wall formed by the large mesh grill (4), this end wall being disposed in alignment with the central cavity (3).

4 Claims, 1 Drawing Figure

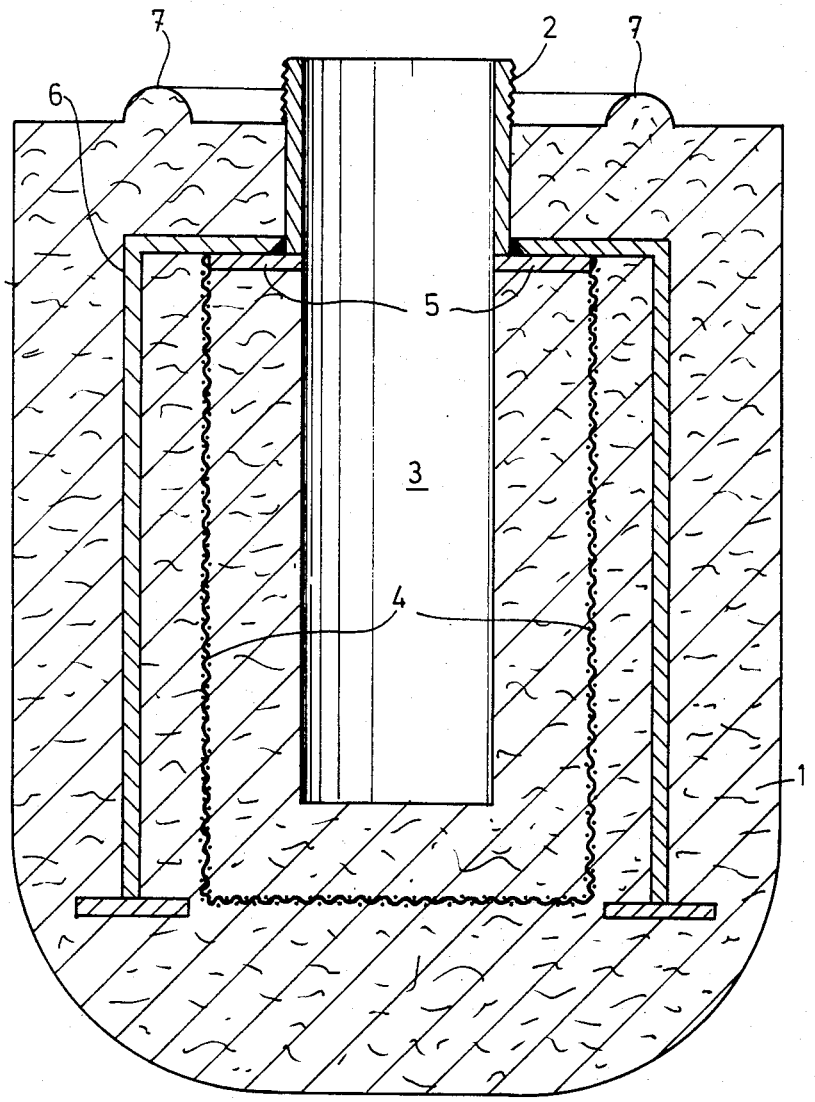
7
2
7
6
5
3
4
1

POROUS NOZZLE FOR BLOWING GAS THROUGH STEEL

The present invention relates to a porous nozzle adapted to be secured to the end of a blowing lance for blowing gas through steel.

Until now, the blowing of gas through steel is effected either with a porous plug that is placed in the bottom of the casting ladle, or by a lance provided with a nozzle with a central opening. The use of a porous plug has the drawback that the plug must be replaced after a very small number of castings and each time the plug is replaced it is necessary to cool the ladle completely to permit these operations. Moveover, during each casting it is necessary to maintain careful surveillance to avoid puncturing the ladle.

The lance with a central blowing hole has the drawback that the gas blowing is too strong and that the metallurgy in the ladle does not have the same result as with the porous plug.

The invention has for its object a porous nozzle adapted to be secured to the end of a blowing lance which may be cooled or not and providing a greater gas blowing surface than the devices of the prior art.

This object is achieved by a porous nozzle characterized by a body of solid porous material, having on its upper surface securement means for securing the body to the end of a blowing lance, said body being provided with a central cylindrical cavity which in in communication with the interior of the bushing to receive an inert gas from said lance.

Preferably the porous body comprises a large-mesh grill which surrounds the central cavity so as to reinforce the porous material of which the body is constructed. In one embodiment, this grill is welded to a metal ring fixed about the bushing. To secure the porous material of which the porous body is constituted more closely, at least one anchoring member is preferably welded to the periphery of the bushing and embedded in the porous material of said body.

The advantages deriving from this arrangement are that the nozzle is capable of forming a much greater number of bubbles, which renders the operation of gas blowing more effective, and that it is possible easily to avoid the plugging of the nozzle while maintaining the pressure of the inert gas in the nozzle during a short lapse of time so as to permit the solidification of the slag and of the steel. Moreover, the replacement of the nozzle may be quickly performed.

The invention is explained hereinafter by means of an embodiment shown on the accompanying drawing.

The porous nozzle comprises a cylindrical body 1, for example of porous concrete, secured to a bushing 2 with screw threads adapted to secure the nozzle to the end of a blowing lance known per se. The porous body 1 having for example a diameter of 220 mm is provided with a central cyindrical cavity 3, 60 mm in diameter adapted to comprise a compression chamber for an inert gas (argon or nitrogen for example). Chamber 3 communicates with the interior of bushing 2. In the material of body 1 and surrounding the wall of the chamber 3 is embedded a large-mesh grill 4 which provides an armature for body 1 so as to render the latter more resistantto handling and to avoid cracks due to thermal shock.

When nozzle 1 secured to the end of a blowing lance is introduced into a steel bath and fed with inert gas which fills compression chamber 3, this inert gas diffuses through the grill 4 and the porous body 1 and flows out into the steel bath.

The construction of the porous nozzle is simple. On bushing 2 is welded a ring 5 on which is secured grill 4. Chamber 3 is formed by introducing into the open end of bushing 2, a cylindrical wood body having the diameter which is desired for chamber 3 and which extends beyond ring 5 for a length equal to the desired length for said compression chamber. Then porous concrete is cast to form the body 1, and then the wooden plug is removed. Upon the bushing 2 is preferably welded a cylindrical member 6 serving as an anchor for more securely securing the porous concrete.

The upper outer face of the body of the nozzle is preferably provided with an annular baffle 7 to avoid penetration of the liquid bath along the joint of the nozzle with the bushing 2.

What is claimed is:

1. Porous nozzle for blowing gas through a bath of steel, characterized by a body (1) of solid porous material, having on its upper face a bushing (2) for securing the body to the end of a blowing lance, said body being formed with a central cylindrical cavity (3) which is in communication with the interior of the bushing (2) for receiving an inert gas from said lance, a large-mesh grill (4) which is embedded in the body and encloses the central cavity (3) so as to reinforce the porous material of the body (1), and a metal ring (5) secured about the bushing (2), the grill (4) being welded to said metal ring (5).

2. Porous nozzle according to claim 1, in which the porous body (1) comprises at least an anchoring member (6) welded to the periphery of the bushing (2) so as to fasten more securely the porous material constituting the body (1), this anchoring member being embedded in the porous material.

3. Porous nozzle according to claim 2, in which said anchoring member is cylindrical and lies outside of and is concentric with the grill (4).

4. Porous nozzle according to claim 1, in which said large mesh grill (4) is cylindrical and terminates in an end wall formed by said large-mesh grill, said end wall being disposed in alignment with said central cavity (3).

* * * * *